US005924272A

United States Patent [19]

Jaschke et al.

[11] Patent Number: 5,924,272

[45] Date of Patent: Jul. 20, 1999

[54] YARN THREADING AND GUIDING DEVICE FOR FALSE TWIST TEXTURING MACHINE

[75] Inventors: Klemens Jaschke, Huckeswagen; Dietrich Berges, Marienheide, both of Germany

[73] Assignee: Barmag AG, Remscheid, Germany

[21] Appl. No.: 08/698,130

[22] Filed: Aug. 15, 1996

[30] Foreign Application Priority Data

Aug. 16, 1995 [DE] Germany ..... 195 30 105
Sep. 27, 1995 [DE] Germany ..... 195 35 931

[51] Int. Cl.[6] ..... D01H 5/28

[52] U.S. Cl. ..... 57/279; 57/280; 57/290; 57/350; 57/356

[58] Field of Search ..... 57/350, 356, 279, 57/280, 290, 291; 254/392, 413

[56] References Cited

U.S. PATENT DOCUMENTS

| | | | |
|---|---|---|---|
| Re. 30,159 | 11/1979 | Kubler | 57/291 |
| 3,448,572 | 6/1969 | Meronen | 57/106 |
| 3,636,697 | 1/1972 | Treptow et al. | 57/280 |
| 3,843,868 | 10/1974 | Whittaker | 219/470 |
| 3,981,128 | 9/1976 | Munker | 57/279 |
| 4,236,323 | 12/1980 | Dammann et al. | 57/290 X |
| 4,565,524 | 1/1986 | Runkel et al. | 432/59 |
| 5,193,334 | 3/1993 | Dammann | 57/291 X |

FOREIGN PATENT DOCUMENTS

| | | |
|---|---|---|
| 0 429 980 | 8/1991 | European Pat. Off. . |
| 2 686 626 | 7/1993 | France . |
| 1 817 084 | 7/1973 | Germany . |
| 23 30 011 | 1/1975 | Germany . |
| 23 48 322 | 7/1975 | Germany . |
| 21 55 514 | 8/1975 | Germany . |
| 25 30 125 | 12/1983 | Germany . |
| 1 269 110 | 4/1972 | United Kingdom . |

*Primary Examiner*—William Stryjewski
*Attorney, Agent, or Firm*—Bell Seltzer Intellectual Property Law Group of Alston & Bird LLP

[57] ABSTRACT

A yarn false twist texturing machine having a vertically adjustable device for threading and guiding the advancing yarn at a location between the heater and the cooling plate of the machine. The threading and guiding device comprises a tubular casing having a rodless magnetic piston mounted for sliding movement therein, and a magnetic sliding element and a yarn guide mounted for sliding movement on the outside of the tubular casing. The polarity of the magnetic sliding element is opposite that of the rodless magnetic piston so that the magnetic sliding element follows the movement of the magnetic piston, and the magnetic piston is moved by compressed air delivered into either one or both ends of the tubular casing.

11 Claims, 7 Drawing Sheets

YARN THREADING AND GUIDING DEVICE FOR FALSE TWIST TEXTURING MACHINE

BACKGROUND OF THE INVENTION

The invention relates to a vertically adjustable device which is adapted for use in threading and guiding an advancing yarn in a false twist texturing machine.

False twist texturing machines having a vertically adjustable yarn threading device are known. Disclosed in DE-PS 23 48 322 is a yarn threading device, which includes a vertically adjustable hand bar with a slideway and a rope mechanism with deflection rolls for overcoming greater operating heights. The mechanism is relatively complicated, requires long operating paths in the manual operation of the hand bar and, moreover, requires great skill and physical effort from the operator.

DE 25 30 125 C2 and corresponding U.S. Pat. No. RE 30,159 disclose a yarn threading device which is manually operated, and is provided with swivel arms for supporting yarn guides at a location between the heater and cooling plate of a false twist texturing machine. This manually operated yarn threading device also requires great physical effort and skill, primarily in the case of very high machines.

DE-PS 1 817 084 discloses a bar with a cross beam for yarn guides, which can be raised and lowered by hand. Also in this instance, an operator must exert great physical effort and high skill to raise or lower the bar.

Likewise known from DE-AS 21 55 514 is a manually displaceable bar with guides, which is adapted for use as a yarn threading device.

Common to all texturing machines of the prior art with vertically adjustable yarn threading devices is that, primarily in the case of great heights, they require from the operator relatively great physical effort as well as great skill for threading the yarn from a lower yarn threading position into an upper yarn threading position. The disadvantage of mechanical yarn threading devices as used in known texturing machines is that the path of displacement of the operating bar extends up to approximately 1.20 meters into the operator aisle. This relatively long bar must be moved by the operator.

It is therefore the object of the present invention to provide a texturing machine with a vertically adjustable yarn threading device, which can be operated with little physical effort and without great skill, in that the distances to be covered by the operator are short.

In each processing station of a yarn false twist texturing machine of the described type, the yarn advances via a feed system, serially between a heater, a cooling plate, a false twist unit, and to a takeup. The adjustable yarn threading device for threading a yarn into the heater and/or cooling plate is maintained at a location between the heater and the cooling plate. Since in the event of a power failure in a machine, the yarns in the heater may melt rapidly or even burn, it is desirable that all yarns be quickly removed from the heaters. To this end, a yarn threading device is needed that is as simple as possible to operate by an operator.

SUMMARY OF THE INVENTION

The above and other objects and advantages of the present invention are achieved by the provision of a yarn threading and guiding device which comprises a tubular casing and a magnetic piston mounted for sliding movement within the tubular casing. A magnetic sliding element is mounted for sliding movement on the outside of said tubular casing, and the magnetic sliding element has a polarity opposite that of the magnetic piston so that the magnetic sliding element follows the sliding movement of the magnetic piston. Also, a yarn guide is mounted to the magnetic sliding element, and control means is provided for selectively supplying compressed air into the tubular casing on opposite sides of the magnetic piston to slidably move the magnetic piston, and the following magnetic sliding element and yarn guide, in either direction along the tubular casing.

Preferably, the control means includes an air control valve, which comprises a housing slidably supporting a control piston therein, and a pneumatic system is provided for moving the control piston between (1) a first stop position wherein compressed air is directed to one side only of the magnetic piston so as to move the magnetic piston in an extending direction, (2) a second stop position wherein compressed air is directed to both sides of the magnetic piston so as to hold the magnetic piston at a fixed location, and (3) a third stop position wherein compressed air is directed to the other side only of the magnetic piston so as to move the magnetic piston in a retracting direction.

The control valve is preferably a 4/3 way valve, and the magnetic piston is controllable such that the yarn threading device can be stopped at any desired position. To this end the 4/3 way valve may be adjusted manually between the first stop position for an extending or upward movement of the yarn guide, a second stop position for holding the yarn guide in a selected position, and a third stop position for retracting the yarn guide downwardly. The different stop positions allow the supply of compressed air from a source of compressed air to be delivered to the upper side or underside of the magnetic piston. When the upper side of the magnetic piston in the tubular casing is biased by compressed air, the magnetic piston is moved in the tubular casing from the top downward, and the magnetic sliding element and the yarn guide follow this movement and are retracted.

However, when the underside of the magnetic piston is biased with compressed air, the magnetic piston is moved upwardly as long as compressed air is supplied, which causes the yarn guide to also extend or move upwardly. When the second stop position is selected, compressed air is supplied both to the upper side and the underside of the magnetic piston, whereby the yarn threading device is held in this position as a result of a pressure equalization between the upper side and the underside of the magnetic piston in the tubular casing. This holding position may be activated both during the downward stroke and during the upward stroke of the yarn threading device in any desired position along the tubular casing.

For additionally controlling the 4/3 way valve, a further embodiment includes a 2/2 way servo-valve, which is activated via a separate control signal. This 2/2 way valve is connected to an additional compressed air inlet end on the 4/3 way valve, so that in the event of a power failure, the 4/3 way valve can be controlled via this additional supply of compressed air, which causes the yarn guide to retract. This is important, inasmuch as in the event of a power failure the heaters maintain their temperature a relatively long time due to their heat capacity. The yarn being no longer advanced may thus come into contact with the heater surfaces and thus be caused to melt or burn. It is therefore important that there be no problem with removing the yarn relatively quickly and easily from the heater or even from the cooling device. This is realized by retracting the yarn guide.

In a further, preferred embodiment, the three stop positions are realized by means of a plunger. This plunger assists in controlling the 4/3 way valve, i.e., its control piston. This control piston is designed and constructed as a double piston, and it controls, as a function of the stop position, the supply of compressed air to the underside and/or to the upper side of the magnetic piston. The different stop positions of the plunger are sufficiently close together, and need to correspond only to the spacing between the individual pistons of the double piston, so as to be able to close or open the corresponding supply lines or discharge lines to or from the underside or upper side of the magnetic piston. This results in short distances, which are easy to be covered by an operator with little physical effort. To realize these stop positions, the plunger is provided with annular grooves, which engage with spring-loaded locking elements, so that the displacement of the plunger causes a locking engagement with a selected groove. The operating direction which is understood to be the direction in which the plunger must be pushed or pulled, corresponds to the desired direction of movement of the yarn guide.

The locking grooves may be arranged either between the plunger handle and the double piston or between the individual pistons of the double piston. The latter design represents a more compact type of construction for the 4/3 way valve serving as control valve.

A further embodiment comprises an advantageous configuration of an upper stop, which includes a contact switch. This contact switch assists in transmitting control pulses to a control device for opening and closing a cover on the heater. Thus, the operator can control both the yarn threading device and the heater cover by a one-time operation of the control valve. In this instance, the heater cover is preferably adjusted with the use of a control device that is biased by compressed air, and so that the yarn threading device and the control device can be supplied by one source of pressure.

BRIEF DESCRIPTION OF THE DRAWINGS

Further advantages, characteristics, and possible applications of the invention are described below in more detail with reference to embodiments in conjunction with the drawings, in which.

DETAILED DESCRIPTION OF THE PREFERRED EMBODIMENTS

Figure 1:
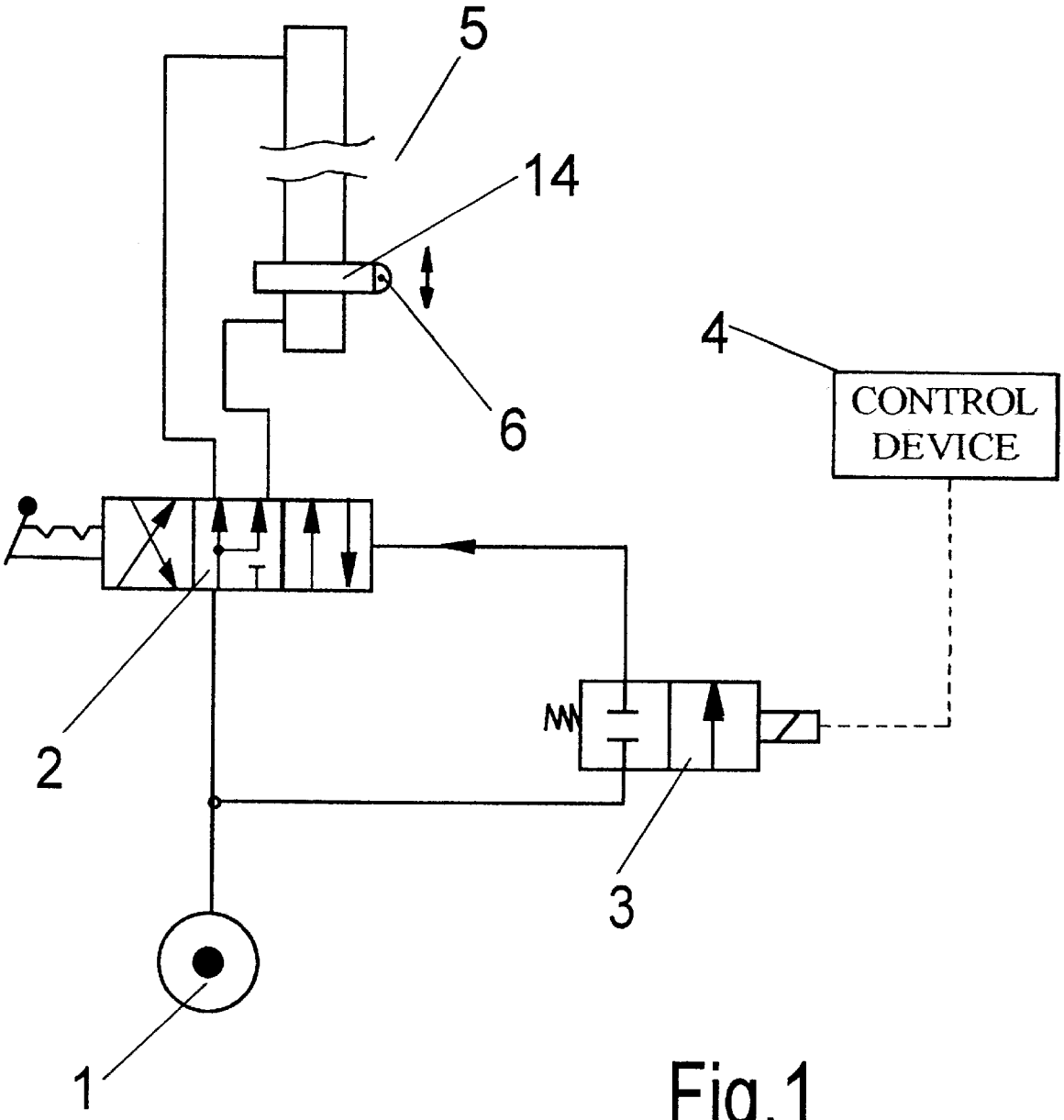
FIG. 1 is a pneumatic circuit diagram of a yarn threading and guiding device that is biased by compressed air and embodies the features of the present invention.

FIG. 1 is a pneumatic circuit diagram of a basic arrangement of a first embodiment of the invention. A source of compressed air 1 is connected, via a 4/3 way valve 2, with a yarn threading and guiding device 5. The yarn threading and guiding device 5 comprises a tubular casing which accommodates a magnetic piston without a piston rod for upward and downward movement by applying pressure to the piston in the manner described below. On the outside of the tubular casing, a sliding element 14 in the form of a magnet is mounted for sliding movement. The magnet has a polarity, which differs from that of the magnetic piston in the interior of the tubular casing. As a result, the magnet or sliding element 14 attached to the outer circumference of the tubular casing is moved up and down when the magnetic piston in the interior of the tubular casing is biased with pressure. The sliding element 14 arranged for displacement on the outer circumference of the tubular casing mounts a yarn guide 6, which permits a yarn to be inserted into a heater 8 or a cooling device 9.

The 4/3 way valve 2 is controlled via a 2/2 way servovalve 3, which itself is activated by a control device 4. The 2/2 way valve 3 is used to connect, in the event of a power failure, the source of compressed air 1 with a space formed in tubular casing 26 of yarn threading and guiding device 5 above the magnetic piston 7, so as to move the piston from the top downward.

Figure 2:
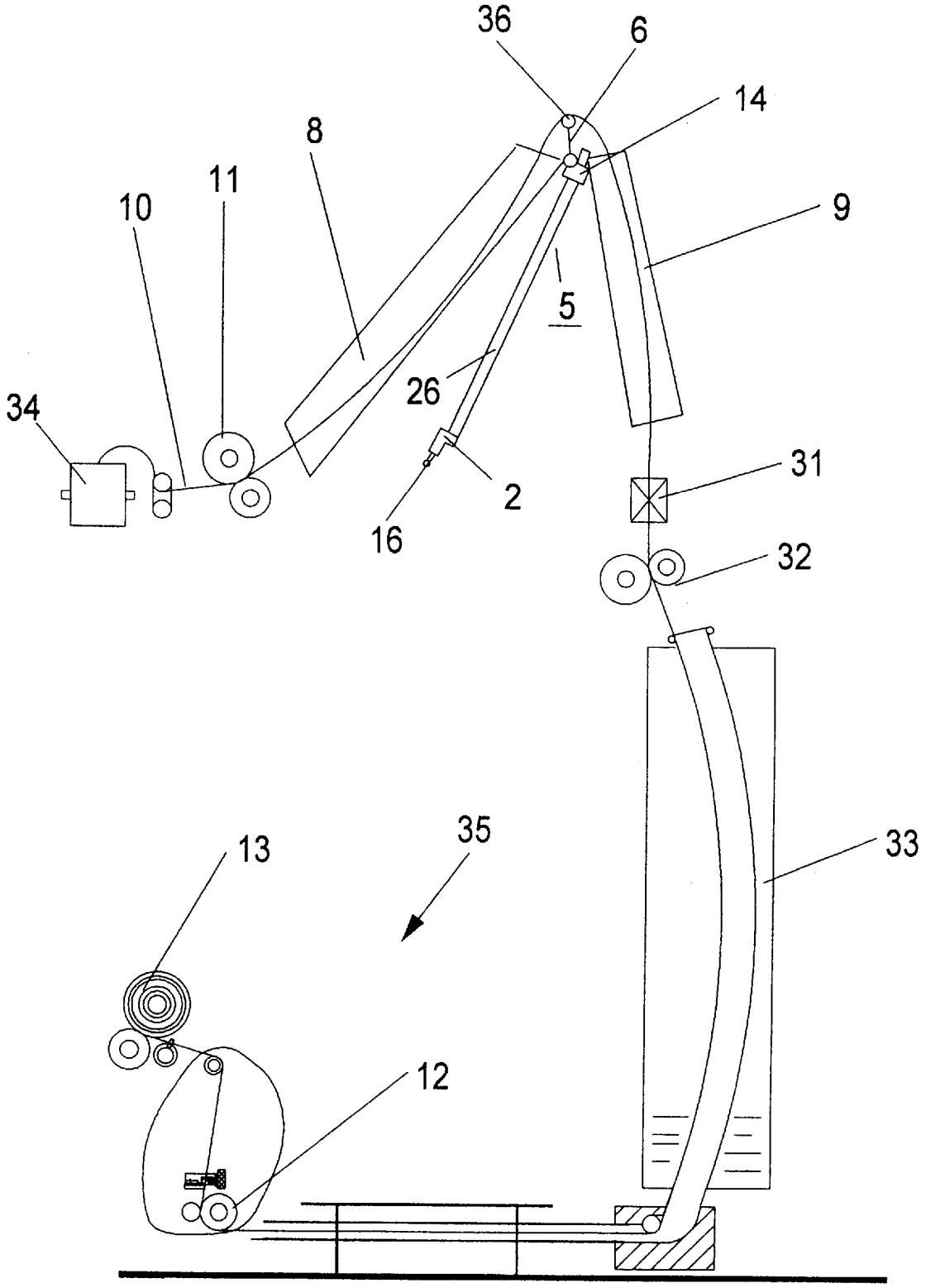
FIG. 2 is a schematic view of the basic components of a yarn false twist texturing machine and which includes a yarn threading and guiding device of the present invention.

FIG. 2 is a schematic view of the basic layout of a yarn false twist texturing machine, wherein in each processing station, a yarn 10 advances from a supply package 34, via a feed system 11 consisting of corresponding feed rolls, to an elongate heater 8. At the end of heater 8, a guide roll 36 is arranged, over which the yarn advances and is deflected, so that it enters thereafter into a cooling device 9. From the cooling device, the yarn 10 advances to a false twist unit 31 and a delivery system 12, from where it is delivered to a takeup 13. In the illustrated embodiment, the yarn 10 advances through a further heater 33 upstream of the delivery system 12. Between heater 33 and false twist unit 31, a feed system 32 is arranged. Shown in the upper portion of the texturing machine, between heater 8 and cooling device 9 above an operator aisle 35, is the yarn threading and guiding device 5, which is an elongate bar constructed as a tubular casing 26. On its upper end, the tubular casing is provided with a connection plug for compressed air, and on its lower end, it accommodates the actual 4/3 way valve 2 that is actuatable by a plunger 16. The sliding element 14 arranged on the outside of tubular casing 26 and mounting the yarn guide 6 is shown in FIG. 2 in its topmost position. The topmost position corresponds to the position, in which the control valve has supplied compressed air from the source of compressed air 1 to the underside of magnetic piston 7, until same reaches its uppermost position in the tubular casing by contacting an inlet plug, or is at its extreme stop.

Figure 3:
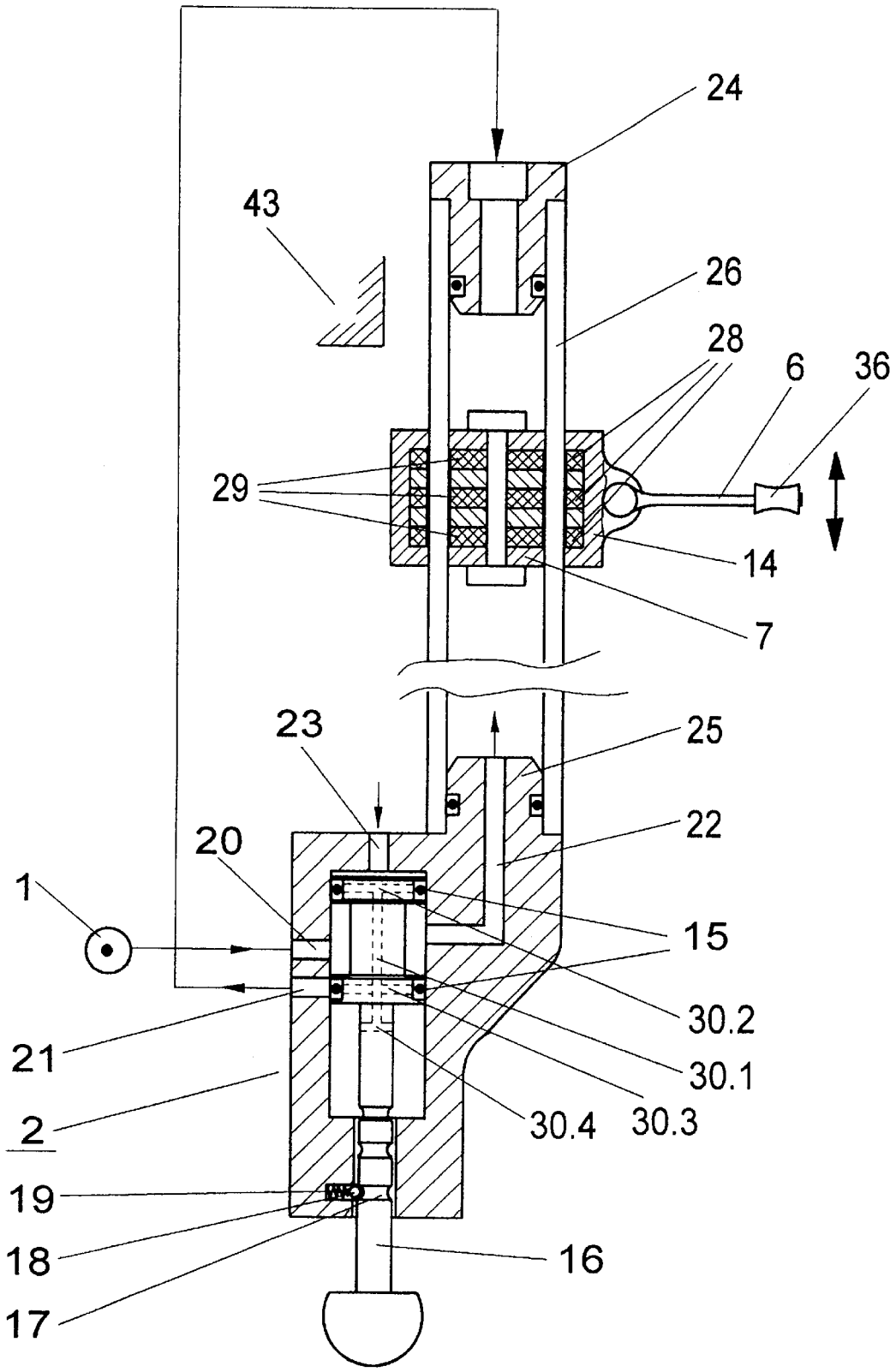
FIG. 3 is an axial sectioned view of a magnetic yarn threading and guiding device controlled by a 4/3 way valve in a first stop position (upward movement) of the control valve.

Illustrated in FIG. 3 is the yarn threading device in a first embodiment of 4/3 way valve 2. The control valve connects to a source of compressed air 1, which supplies to it compressed air. Depending on the position of a double piston formed by two individual pistons 15, a supply line extends from this control valve to the underside or to the upper side of a rodless magnetic piston 7 which is arranged in cylindrical tube 26. Located for sliding movement along the outer circumference of tube 26 is sliding element 14 with magnets having a reversed polarity with respect to the polarity of the magnet of piston 7. Attached to this sliding element is the yarn guide 6 with the guide roll 36. The magnetic piston 7 comprises several, parallel arranged ring magnets 29. Opposite to these ring magnets, on the outside, ring magnets 28 are accommodated in sliding element 14. Arranged in 4/3 way valve 2 are a compressed air line 20 for connecting the source of compressed air 1 to the control valve, a compressed air line 21 for connecting control valve 2 with the upper side of magnetic piston 7 via a compressed air inlet end 24 in the upper side of tubular casing 26 for biasing the upper side of the magnetic piston, compressed air connection line 22 for biasing the magnetic piston 7 from its underside, as well as a compressed air connection line 23 for automatically retracting the yarn guide, i.e., removing the yarn from heater 8 or cooling device 9. The double piston 15 of the control valve 2 is mounted to a plunger 16 which has a handle. Between the double piston 15 and the plunger handle, annular locking grooves 17 are machined in the plunger 16. These locking grooves correspond to the respective stop positions of the yarn guide 6. Accommodated in the housing of control valve 2 is a ball 18 biased by a spring 19. This ball engages in one of grooves 17 corresponding to a respective one of the stop positions and, thus, locks in a particular stop position. The first stop position, as shown in FIG. 3, corresponds to the position, in which the compressed air from the source of compressed air 1 biases the underside of magnetic piston 7 via compressed air inlet 20 and compressed air connection line 22. As a result, the magnetic piston 7 extends, i.e., it is moved from the bottom upward. Compressed air line 21 is connected with an air channel 30.1–30.4 of the double piston, so that the upper side of magnetic piston 7 remains unbiased. If the compressed air supply continues long enough, the magnetic piston 7 will move upward until reaching a stop 43. Due to the different polarity between the ring magnets of magnetic piston 7 in the interior of tubular casing 26 and ring magnet 28 sliding along the outside thereof, the yarn guide 6 is moved synchronously with the movement of magnetic piston 7.

Figure 4:
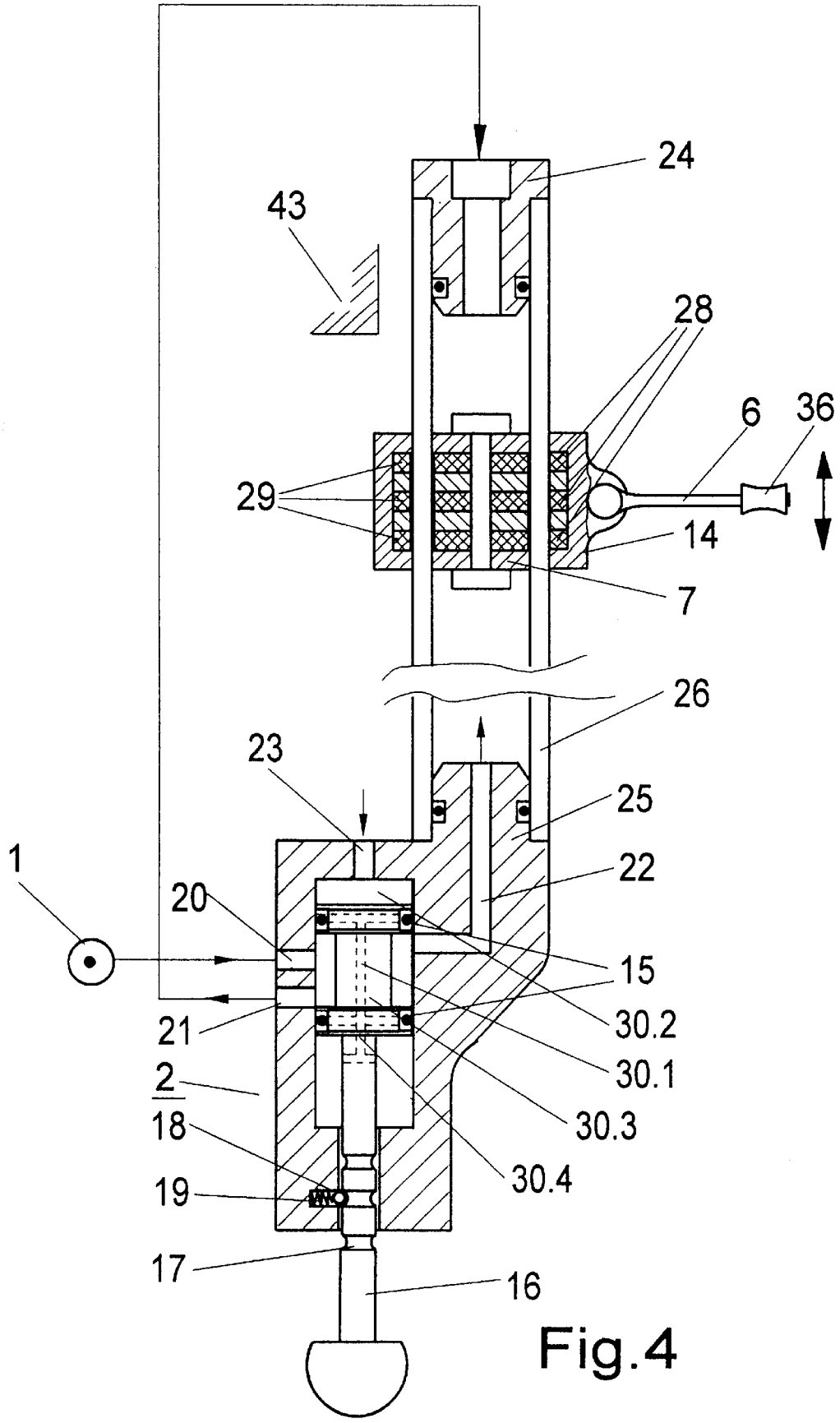
FIG. 4 is an axial sectioned view of a yarn threading and guiding device in accordance with FIG. 3 in a second stop position (holding position) of the control valve.

FIG. 4 corresponds to the basic layout of the present invention in accordance with FIG. 3. However, plunger 16 is in its second stop position, which corresponds to the holding position of yarn guide 6. When ball 18 with spring 19 is engaged in the second groove 17, the connection line 20 for supplying compressed air from the source of compressed air 1, connection line 21 for biasing the upper side of magnetic piston 7, and connection line 22 for biasing the underside of magnetic piston 7 are arranged between the individual pistons 15 of the double piston. As a result, compressed air flows from the source of compressed air both to the upper side and the underside of magnetic piston 7. Consequently, the same pressure exists both on the upper and the underside of magnetic piston 7, thereby holding the magnetic piston and, thus, yarn guide 6 in the particular position.

Figure 5:
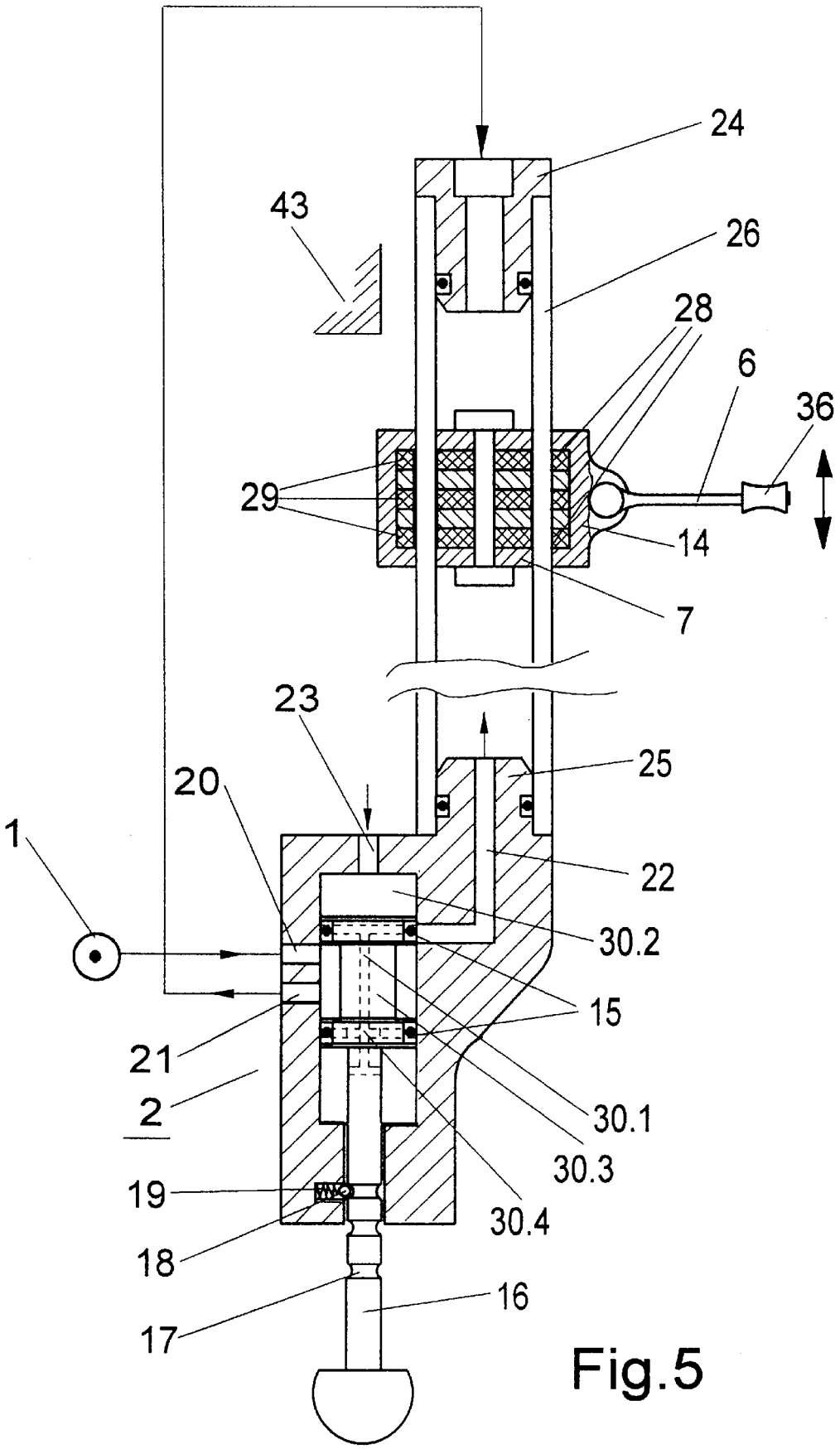
FIG. 5 is an axial sectioned view of a yarn threading and guiding device in accordance with FIG. 3 in a third stop position (retraction) of the control valve.

Shown in FIG. 5 is the yarn threading device of FIG. 3, with plunger 16 being however in a third stop position. This third stop position, in which ball 18 with spring 19 engages in a third locking groove causes connection line 22 to connect to air channel 30.1–30.4, so that the underside of magnetic piston 7 is vented. The two other connecting lines 20, 21 are thus interconnected via the space between the individual pistons 15, so that compressed air flows from the source of compressed air 1 directly, via inlet end 24, to the upper side of magnetic piston 7, whereby same is moved together with yarn guide 6 from the top downward.

To be able to remove all yarns quickly from the heaters in the event of a power failure, so as to prevent the yarns from burning, the control valve 2 is connected to a further compressed air line 23, which terminates in a chamber on the front side of the double piston. If this compressed air inlet 23 receives compressed air, preferably from the source of compressed air 1, the double piston will be displaced, without manual assistance, to the third stop location shown in FIG. 5, i.e., to a switching position for retracting the yarn threading device.

For purposes of examining whether all yarn threading devices are in their respective operating position, a simple laser system with a sensor may be used. Such a laser, when in use, is arranged crosswise to yarn threading devices 5, so that the laser beam can detect the position of each yarn threading device 5. This method may be applied for monitoring the actual position of yarn guides 6, but also for detecting the position of plunger 16.

Figure 6:
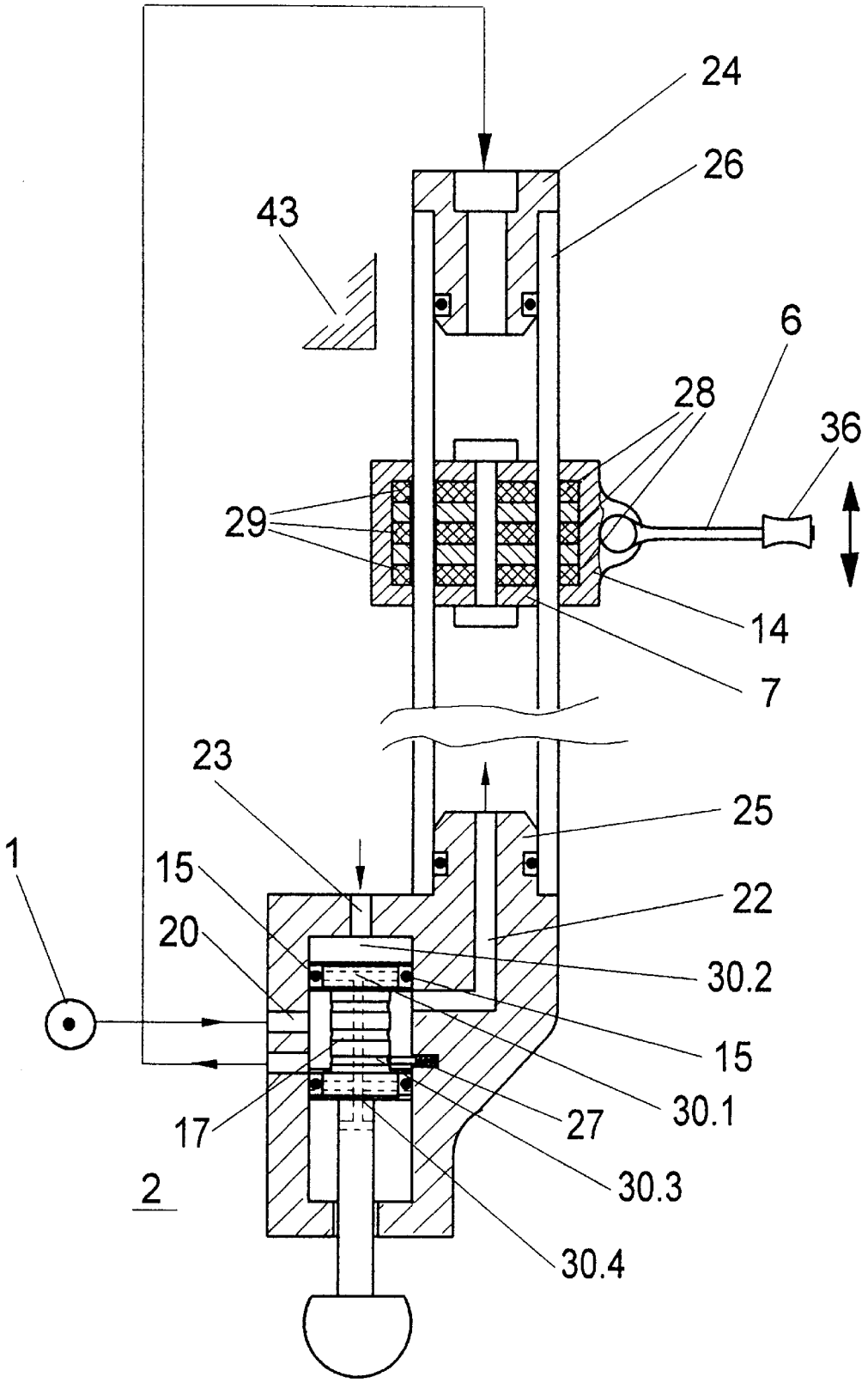
FIG. 6 is an axial sectioned view of a further embodiment with locking grooves arranged between the individual pistons of a double piston.

Shown in FIG. 6 is a further embodiment having a basic layout which corresponds to that of FIG. 3. In this embodiment, the control valve 2 is provided in the region between the two pistons 15 of the double piston with locking grooves for securing the corresponding stop locations. The locking elements include a pin 27, which engages into the corresponding groove 17 depending on the stop location.

Preferably, the tubular casing 26 of yarn threading device 5 is made of metal, such as stainless steel. However, it is also possible to make the tubular casing 26 from plastic tubing. In any event the tubular casing is inserted in a molded aluminum body, which houses the control piston 15 and plunger 16. Preferably, the compressed air lines are cast integral with the molded body itself.

Figure 7:
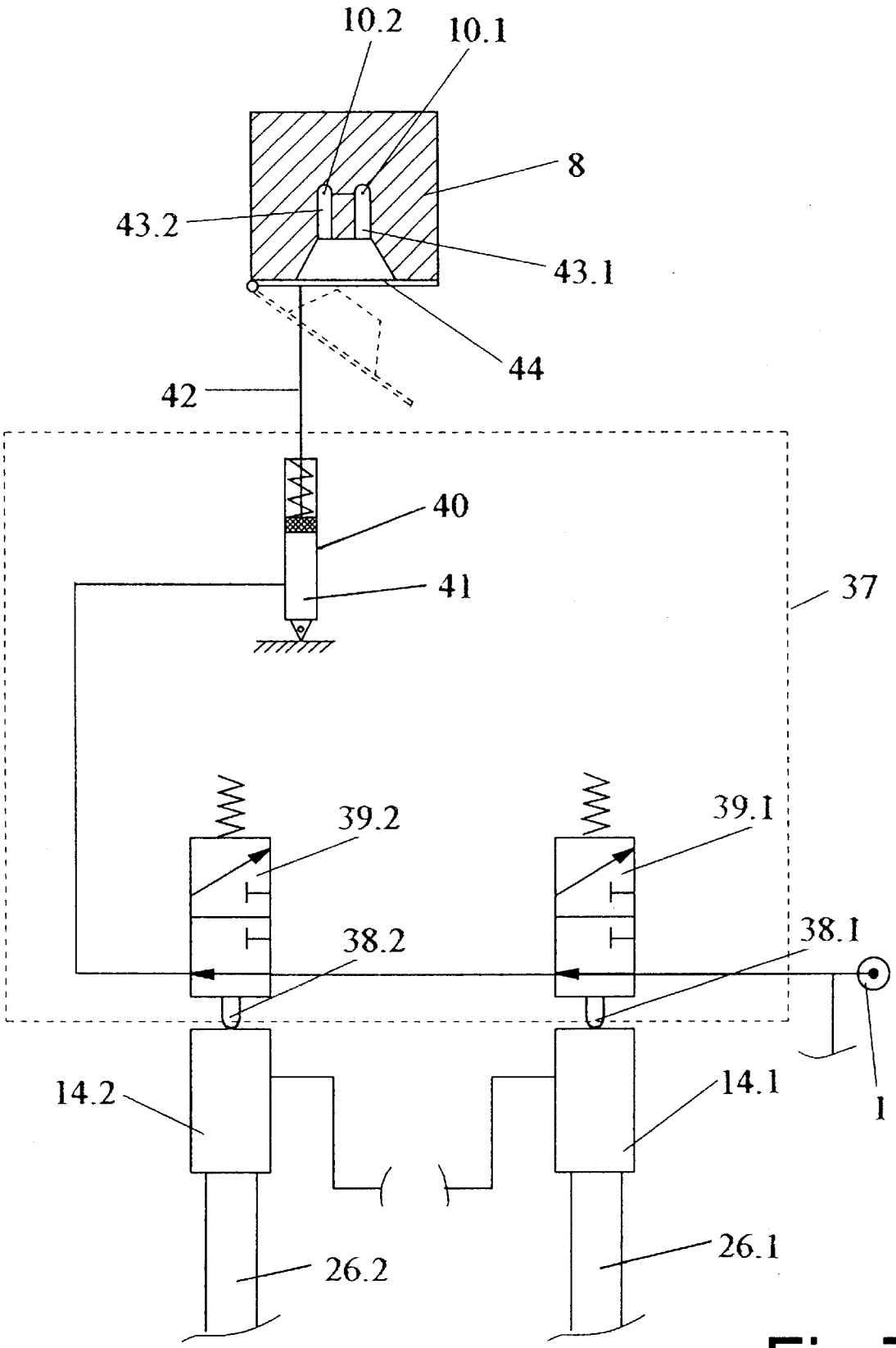
FIG. 7 illustrates two yarn threading and guiding devices in their extended position for operating a heating device.

FIG. 7 illustrates a further embodiment, in which two yarn threading devices have their sliding elements 14.1,14.2 resting against separate upper stops, which take the form of contact switches 38.1 and 38.2. Each contact switch 38.1, 38.2 is part of a control device 37, which includes control valves 39.1 and 39.2 and a closing cylinder 40. In the illustrated position, each closing valve 39.1, 39.2 is pushed by means of contact switch 38.1, 38.2 to its left switching position. As a result, each contact switch receives a switching pulse from sliding element 14.1, 14.2. In the left switching position of both control valves, which are 3/2 way valves, the source of compressed air 1 is connected with a pressure chamber 41 of a closing cylinder 40. The closing cylinder 40 is connected by means of its piston rod 42 with a cover 44 of heater 8. When pressure is applied to chamber 41, the piston extends and closes the cover 44. In the illustrated embodiment, the heater 8 has two heating channels 43.1 and 43.2. A yarn 10.1, 10.2 advances in each heating channel. The control device 37 is therefore provided with two control valves 39.1, 39.2, which are activated each by one contact switch 38.1, 38.2. Each contact switch forms the stop for the respective yarn threading device of yarns 10.1 and 10.2. In this arrangement, the cover 44 is closed only when both yarn guides or sliding elements 14.1 and 14.2 contact their respective stop. As soon as one sliding element or yarn guide moves away from its stop, the control valve switches to its right position. In this switching position, air is removed from the pressure chamber 41 of closing cylinder 40, so that the cover 44 of heater 8 is opened or remains open, thus permitting a removal of the yarn.

In the drawings and the specification, there have been set forth preferred embodiments of the invention and, although specific terms are employed, the terms are used in a generic and descriptive sense only and not for the purpose of limitation, the scope of the invention being set forth in the following claims.

That which is claimed is:

1. A yarn threading and guiding device for use in a yarn false twist texturing machine, and comprising a tubular casing, a magnetic piston mounted for sliding movement within the tubular casing, a magnetic sliding element mounted for sliding movement on the outside of said tubular casing, said magnetic sliding element having a polarity opposite that of the magnetic piston so that the magnetic sliding element follows the sliding movement of the magnetic piston, a yarn guide mounted to the magnetic sliding element, and control means for selectively supplying compressed air into the tubular casing on opposite sides of the magnetic piston to slidably move the magnetic piston, and the following magnetic sliding element and yarn guide, in either direction along the tubular casing, said control means comprising an air control valve which includes a housing slidably supporting a control piston therein, and means for moving the control piston between (1) a first stop position wherein compressed air is directed to one side only of the magnetic piston so as to move the magnetic piston in an extending direction, (2) a second stop position wherein compressed air is directed to both sides of the magnetic piston so as to hold the magnetic piston at any desired location along the tubular casing, and (3) a third position wherein compressed air is directed to the other side only of the magnetic piston so as to move the magnetic piston in a retracting direction.

2. The yarn guide as defined in claim 1 wherein said air control valve comprises a 4/3 way valve.

3. The yarn guide as defined in claim 1 wherein said control means further comprises a servo-valve which is responsive to an external signal for moving said control piston to said third stop position.

4. The yarn guide as defined in claim 1 wherein said means for moving the control piston comprises a plunger which is fixed thereto and extends to a location outside of said housing so as to be manually engageable.

5. The yarn guide as defined in Claim 4 wherein said means for moving the control piston further comprises a plurality of annular grooves positioned on said plunger, and a spring loaded locking element mounted to said housing for releasably engaging a selected one of said grooves.

6. The yarn guide as defined in Claim 4 wherein said control piston comprises spaced apart double pistons, and wherein said means for moving the control piston further comprises a plurality of annular grooves positioned between said double pistons of said control valve, and a spring loaded locking element mounted to said housing for releasably engaging a selected one of said grooves.

7. A yarn texturing machine comprising an elongate yarn heater, a yarn cooling plate, a false twist unit, a yarn take-up, and means for serially advancing a yarn therebetween, a yarn threading and guiding device positioned to engage the advancing yarn at a location between said yarn heater and said cooling plate, said yarn threading and guiding device comprising a tubular casing, a magnetic piston mounted for sliding movement within the tubular casing, a magnetic sliding element mounted for sliding movement on the outside of said tubular casing, said magnetic sliding element having a polarity opposite that of the magnetic piston so that the magnetic sliding element follows the sliding movement of the magnetic piston, a yarn guide mounted to the magnetic sliding element, and control means for selectively supplying compressed air into the tubular casing on opposite sides of the magnetic piston to slidably move the magnetic piston, and the following magnetic sliding element and yarn guide, in either direction along the tubular casing said control means comprising an air control valve which includes a housing slidably supporting a control piston therein, and means for moving the control piston between (1) a first stop position wherein compressed air is directed to one side only of the magnetic piston so as to move the magnetic piston and the magnetic sliding element and the yarn guide in an extending direction and toward the location between said yarn heater and said cooling plate, (2) a second stop position wherein compressed air is directed to both sides of the magnetic piston so as to hold the magnetic piston and the magnetic sliding element and the yarn guide at any desired location along the tubular casing, and (3) a third stop position wherein compressed air is directed to the other side only of the magnetic piston so as to move the magnetic piston and the magnetic sliding element and the yarn guide in a retracting direction and away from the location between said yarn heater and said cooling plate.

8.The yarn guide as defined in claim 7 wherein said control means further comprises a servo-valve which is responsive to an external signal for moving said control piston to said third stop position.

9. The yarn guide as defined in claim 7 wherein said yarn heater includes an elongate body having an elongate heating channel therein, and a cover pivotally mounted to said body so as to be selectively moveable between a closed position overlying the heating channel and an open position wherein the heating channel is open, and further comprising a contact switch positioned to be actuated by engagement with said magnetic sliding element upon said magnetic sliding element and said yarn guide reaching the location between said yarn heater and said cooling plate, and means for pivoting the cover to its closed position upon actuation of the contact switch and pivoting the cover to its open position when the contact switch is not actuated.

10. A yarn threading and guiding device for use in a yarn false twist texturing machine, and comprising a tubular casing, a magnetic piston mounted for sliding movement within the tubular casing, a magnetic sliding element mounted for sliding movement on the outside of said tubular casing, said magnetic sliding element having a polarity opposite that of the magnetic piston so that the magnetic sliding element follows the sliding movement of the magnetic piston, a yarn guide mounted to the magnetic sliding element, and control means for selectively supplying compressed air into the tubular casing on opposite sides of the magnetic piston to slidably move the magnetic piston, and the following magnetic sliding element and yarn guide, in either direction along the tubular casing, said control means comprising an air control valve which includes a housing slidably supporting a control piston therein, and means for moving the control piston between (1) a first stop position wherein compressed air is directed to one side only of the magnetic piston so as to move the magnetic piston in an extending direction, and (2) a further stop position wherein compressed air is directed to the other side only of the magnetic piston so as to move the magnetic piston in a retracting direction, a sensor for sensing a power failure to the yard false twist texturing machine, and wherein said means for moving the control piston includes a valve which is responsive to a signal from said sensor for moving said control piston to said further stop position.

11. The yarn guide as defined in claim 10 wherein said means for moving the control piston further includes a plunger which is fixed to said control piston and extends to a location outside of said housing so as to be manually engageable.

* * * * *